US008228135B2

(12) United States Patent
Rhodes

(10) Patent No.: US 8,228,135 B2
(45) Date of Patent: Jul. 24, 2012

(54) BAND COMBINING FILTER

(75) Inventor: John David Rhodes, Menston (GB)

(73) Assignee: Filtronic Wireless Ltd, Shipley (GB)

( * ) Notice: Subject to any disclaimer, the term of this patent is extended or adjusted under 35 U.S.C. 154(b) by 200 days.

(21) Appl. No.: 12/390,788

(22) Filed: Feb. 23, 2009

(65) Prior Publication Data

US 2009/0231056 A1 Sep. 17, 2009

Related U.S. Application Data

(63) Continuation-in-part of application No. 11/611,653, filed on Dec. 15, 2006, now abandoned.

(51) Int. Cl.
*H01P 5/12* (2006.01)
*H01P 5/18* (2006.01)

(52) U.S. Cl. ..... 333/110; 333/117

(58) Field of Classification Search ..... 333/109, 333/110, 116, 117
See application file for complete search history.

(56) References Cited

U.S. PATENT DOCUMENTS 4,060,779 A * 11/1977 Atia et al. ..... 333/212
4,254,385 A * 3/1981 Childs et al. ..... 333/104
4,385,378 A * 5/1983 Kreutel, Jr. ..... 370/203
5,323,126 A * 6/1994 Spezio et al. ..... 333/109
5,375,257 A * 12/1994 Lampen ..... 455/83

FOREIGN PATENT DOCUMENTS

FR 1442904 5/1966

* cited by examiner

*Primary Examiner* — Dean O Takaoka
(74) *Attorney, Agent, or Firm* — Howard & Howard Attorneys PLLC

(57) ABSTRACT

A band combining filter for passing signals in a communications band includes a plurality of cascaded directional filters. Each directional filter has at least two inputs and at least two outputs. The nth directional filter is arranged such that output signals $O_1$ and $O_2$ from the first and second outputs are related to input signals $I_1$, $I_2$ to the first and second inputs by the relation $$\begin{pmatrix} O_1 \\ O_2 \end{pmatrix} = \begin{pmatrix} R_{n1} & T_{n2} \\ T_{n1} & R_{n2} \end{pmatrix} \begin{pmatrix} I_1 \\ I_2 \end{pmatrix}$$

with R and T being reflection and transmission functions respectively. The directional filters are connected in a cascade with the first and second inputs of the nth directional filter being connected to the first and second outputs of the (n−1)th directional filter respectively in the cascade. At least one of the reflection functions $R_n$ overlaps with the corresponding reflection function $R_{n-1}$ within the communication band but is different thereto.

22 Claims, 7 Drawing Sheets

BAND COMBINING FILTER

CROSS-REFERENCE TO RELATED APPLICATIONS

This application is a continuation-in-part of application Ser. No. 11/611,653 filed Dec. 15, 2006.

BACKGROUND OF THE INVENTION

The present invention relates to a band combining filter and a signal transmitter including such a filter. More particularly, but not exclusively, the present invention relates to a band combining filter comprising a plurality of directional filters connected together in a cascade.

There is an interesting demand to combine different types of communications systems on to a common antenna by subdividing a communication band by frequency allocation. There are several known techniques by which this may be accomplished however the need for a high power and high linearity makes known systems complex and expensive.

The band combining filter according to the invention seeks to overcome this problem.

SUMMARY OF THE INVENTION AND ADVANTAGES

Accordingly, in a first aspect the present invention provides a band combining filter for passing signals in a communications band, the band combining filter comprising a plurality of cascaded directional filters, each directional filter having at least two inputs and at least two outputs, the nth directional filter being arranges such that the output signals $O_1$ and $O_2$ from the first and second outputs are related to the input signals $I_1$, $I_2$ to the first and second inputs by the relation $$\begin{pmatrix} O_1 \\ O_2 \end{pmatrix} = \begin{pmatrix} R_{n1} & T_{n2} \\ T_{n1} & R_{n2} \end{pmatrix} \begin{pmatrix} I_1 \\ I_2 \end{pmatrix}$$

with R and T being reflection and transmission functions respectively;

the directional filters being connected in a cascade with the first and second inputs of the nth directional filter being connected to the first and second outputs of the (n−1)th directional filter respectively in the cascade;

characterised in that at least one of the reflection functions $R_n$ overlaps with the corresponding reflection function $R_{n-1}$ within the communication band but is different thereto.

Overlapping of the reflection functions of the directional filters within the communication band results in interaction between the cascaded directional filters. The resulting band combining filter has a number of advantages such as an enhanced group delay or better selectivity.

The directional filters can be symmetric and reciprocal filters with $R_{n1}=R_{n2}=R_n$ and $T_{n1}=T_{n2}=T_n$.

Preferably, at least one of the directional filters comprises a first signal splitter having first input port connected to the first input and a first output port connected to the first output;

a second signal splitter having a second input port connected to the second input and a second output port connected to the second output;

each of the first and second signal splitters having first and second connection ports;

the two first connection ports being connected together by a first filter;

the two second connection ports being connected together by a second filter.

The first and second signal splitters can be 3 dB hybrids.

The first and second filters can be identical.

Alternatively, the first and second filters can be different to each other.

Each of the first and second filters of at least one directional filter can comprise a low pass filter, high pass filter, band stop filter or band pass filter within the communications band.

The first and second filters of at least one directional filter can be frequency independent within the communication band.

Preferably, the band combining filter comprises first and second directional filters only.

Preferably, each of the first and second filters of the first directional filter comprises a low pass filter, a high pass filter, a band stop filter or band pass filter within the communications band and the first and second filters of the second directional filter are frequency independent within the communications band.

At least one of the first and second filters of the first directional filter can be a low pass filter, the low pass filter being a ladder filter of even order.

In a further aspect of the invention there is provided a signal transmitter comprising a plurality of cascaded directional filters;

each directional filter having at least two inputs and at least two outputs, the nth directional filter being arranges such that the output signals $O_1$ and $O_2$ from the first and second outputs are related to the input signals $I_1$, $I_2$ to the first and second inputs by the relation $$\begin{pmatrix} O_1 \\ O_2 \end{pmatrix} = \begin{pmatrix} R_{n1} & T_{n2} \\ T_{n1} & R_{n2} \end{pmatrix} \begin{pmatrix} I_1 \\ I_2 \end{pmatrix}$$

with R and T being reflection and transmission functions respectively;

the directional filters being connected in a cascade with the first and second inputs of the nth directional filter being connected to the first and second outputs of the (n−1)th directional filter respectively in the cascade;

at least one of the reflection functions $R_n$ overlapping with the corresponding reflection function $R_{n-1}$ within the communication band but is different thereto;

a first signal source in electrical communication with the first input of the first directional filter in the cascade;

a second signal source in electrical communication with the second input of the first directional filter in the cascade; and, an antenna connected to an output of the last directional filter in the cascade.

The directional filters can be symmetric and reciprocal filters with $R_{n1}=R_{n2}=R_n$ and $T_{n1}=T_{n2}=T_n$.

Preferably, at least one of the directional filters comprises a first signal splitter having first input port connected to the first input and a first output port connected to the first output;

a second signal splitter having a second input port connected to the second input and a second output port connected to the second output;

each of the first and second signal splitters having first and second connection ports;

the two first connection ports being connected together by a first filter;

the two second connection ports being connected together by a second filter.

Preferably, the first and second signal splitters are 3 dB hybrids.

The first and second filters can be identical.

Alternatively, the first and second filters can be different to each other.

Preferably, each of the first and second filters of at least one directional filter comprises a low pass filter, high pass filter, band stop filter or band pass filter within the communications band.

The first and second filters of at least one directional filter can be frequency independent within the communication band.

The signal transmitter according to the invention can comprise first and second directional filters only.

Preferably, each of the first and second filters of the first directional filter comprises a low pass filter, a high pass filter, a band stop filter or band pass filter within the communications band and the first and second filters of the second directional filter are frequency independent within the communications band.

At least one of the first and second filters of the first directional filter can be a low pass filter, the low pass filter being a ladder filter of even order.

BRIEF DESCRIPTION OF THE DRAWINGS

The present invention will now be described by way of example only, and not in any limitative sense, with reference to the accompanying drawings in which FIGS. 1(*a*) and 1(*b*) show directional filters of embodiments of band combining filters according to the invention.

DETAILED DESCRIPTION OF THE INVENTION

Figure 1A:
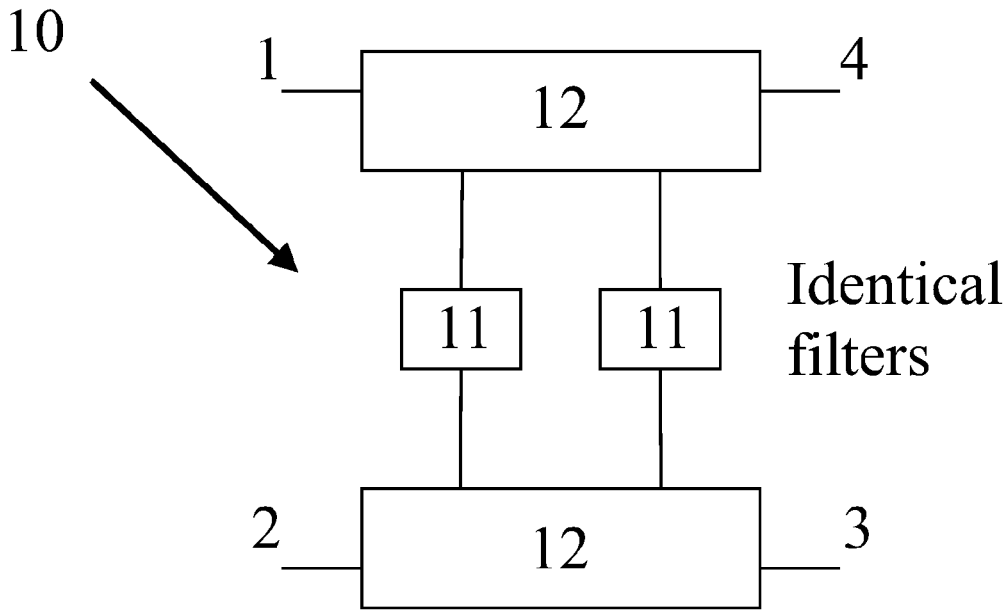
Figure 1B:
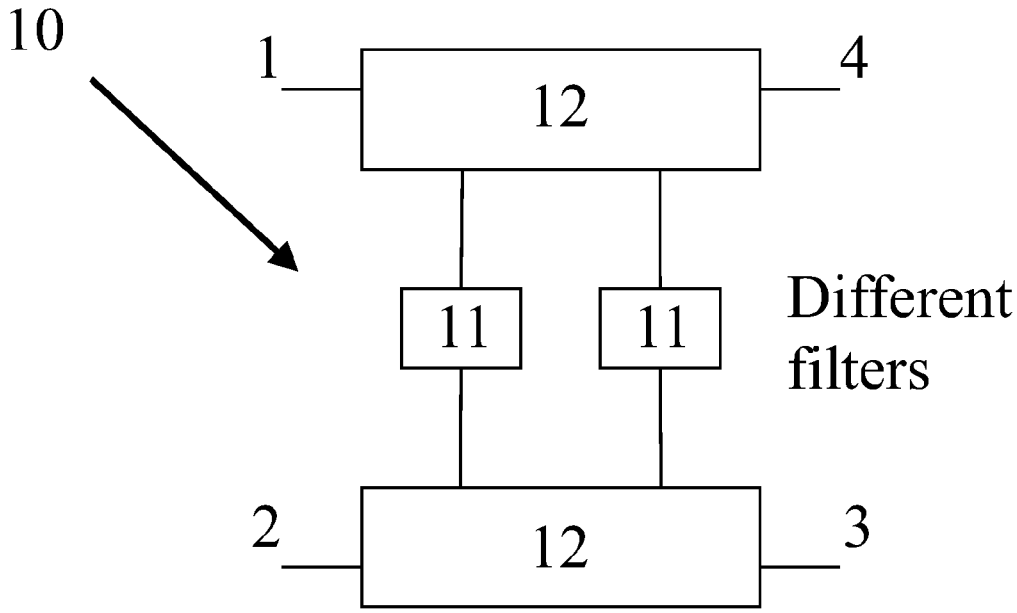

In its simplest form the directional filter 10 is a 4-port device consisting of two identical filters 11 and a pair of 3 dB hybrids 12 as shown in FIG. 1(*a*).

If the scattering matrix of one of the reciprocal filters 11 is:—

$$[S] = \begin{bmatrix} S_{11} & S_{21} \\ S_{21} & S_{22} \end{bmatrix} \tag{1}$$

and a signal is applied at a first port 1, then none of the power is reflected at the first port 1; the second port 2 is totally isolated and the transfer characteristics to the third and fourth ports 3,4 are:—

$$T_4 = jS_{11}$$

$$T_3 = jS_{21} \tag{2}$$

If the filters 11 are assumed to be the lossless then $$|T_4|^2 + |T_3|^2 = 1 \tag{3}$$

In an alternative embodiment of the invention the filters 11 are not identical to each other. This is shown in FIG. 1(*b*). For mathematical convenience the embodiment of FIG. 1(*a*) is described in detail.

Multipath Directional Filters

Figure 2:
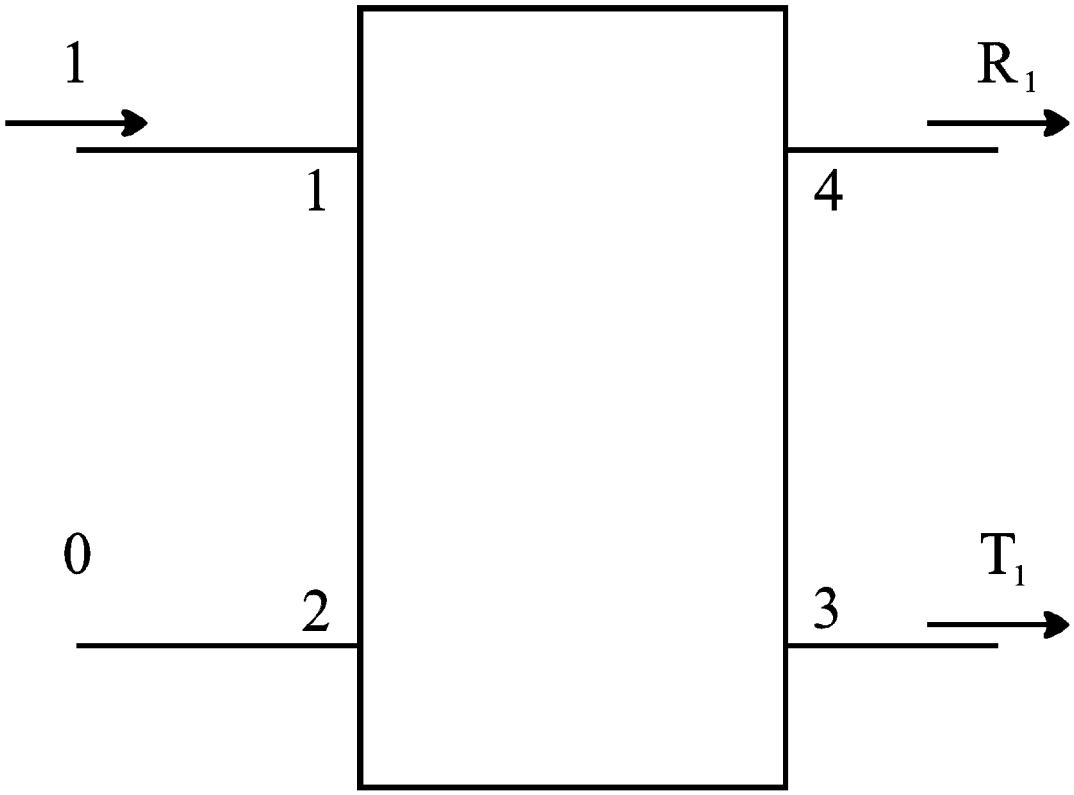
FIG. 2 shows a directional filter of a band combining filter according to the invention in schematic form.

To simplify the analysis, it will be assumed that the filters 11 are symmetrical, although this is not a necessary requirement. A single directional filter 10 is then defined in FIG. 2, and for a lossless network:—.

$$|T_1|^2 + |R_1|^2 = 1 \tag{4}$$

Figure 3:
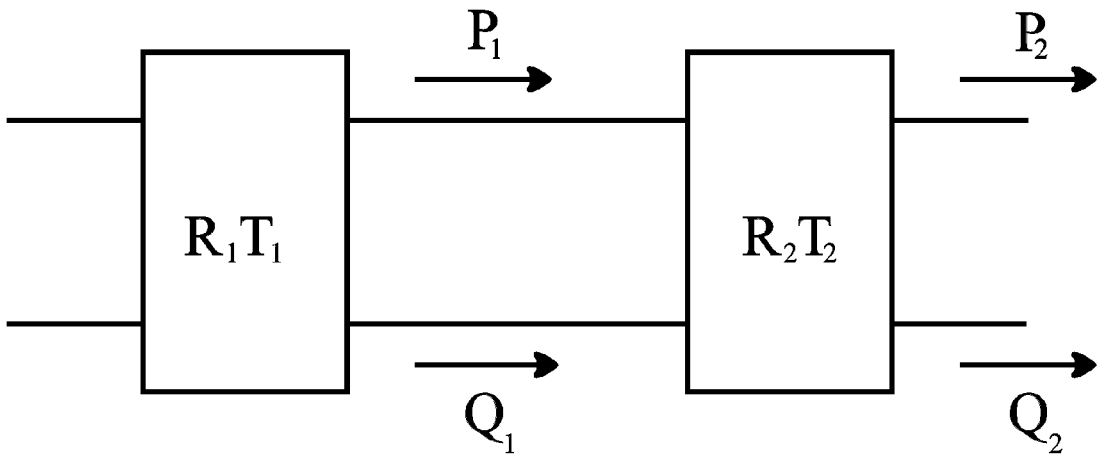
FIG. 3 shows two directional filters connected in a cascade to form a band combining filter according to the invention.

Cascading two directional filters 10 to produce a bandpass filter 13 according to the invention is shown in FIG. 3.

The outputs are:—

$$P_1 = R_1, Q_1 = T_1 \tag{5}$$

and $$P_2 = P_1 R_2 + Q_1 T_2$$

$$Q_2 = P_1 T_2 + Q_1 R_2 \tag{6}$$

For a lossless network then $$|P_2|^2 + Q_2|^2 = 1 \tag{7}$$

Figure 4:
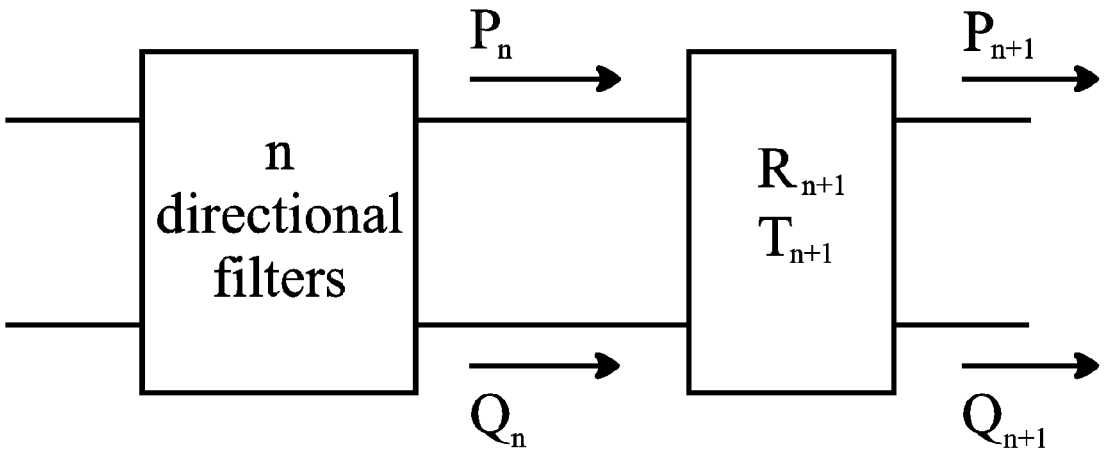
FIG. 4 shows in schematic form N directional filters connected in a cascade to form a band combining filter according to the invention.

For the general case containing n directional filters 10 if an additional device is added one has the situation shown in FIG. 4, where $$P_{n+1} = P_n R_{n+1} + Q_n T_{n+1}$$

$$Q_{n+1} = P_n T_{n+1} + Q_n R_{n+1} \tag{8}$$

and for the lossless case.

$$|P_{n+1}|^2 + |Q_{n+1}|^2 = 1 \tag{9}$$

Thus, the recurrence formula for generating the overall network performance is, $$P_{r+1} = P_r R_{r+1} + Q_r T_{r+1}$$

$$Q_{r+1} = P_r T_{r+1} + Q_r R_{r+1} \tag{10}$$

For r=1→n, with the initial conditions, $$P_1 = R_1, Q_1 = T_1 \tag{11}$$

Design Example for a Cascade of Two Directional Filters

For the case of two directional filters 10 in cascade one has the network equations given in equation 6. Let the first network consist of two lowpass ladder networks of even degree where one may write, $$T_1 = \frac{-1}{D_{2n}(p)} \tag{12}$$

and $$R_1 = \frac{jN_n(p^2)}{D_{2n}(p)} \tag{13}$$

Where N and D are known terms in network theory.

For a lossless network $$D_{2n}(p)D_{2n}(-p) = 1 + N_n^2(p^2) \tag{14}$$

Let the second network be frequency independent defined as:—

$$T_2 = \frac{-j}{\sqrt{1+\varepsilon^2}} \tag{15}$$

$$R_2 = \frac{\varepsilon}{\sqrt{1+\varepsilon^2}}$$

which can be realised as a single proximity coupler with '$\epsilon$' relatively small.

Hence, $$P_2 = \frac{j\varepsilon N_n(p^2)}{\sqrt{1+\varepsilon^2}\ D_{2n}(p)} + \frac{j}{\sqrt{1+\varepsilon^2}\ D_{2n}(p)} \tag{16}$$

$$= \frac{j(\varepsilon N_n(p^2)+1)}{\sqrt{1+\varepsilon^2}\ D_{2n}(p)}$$

and $$Q_2 = \frac{N_n(p^2)-\varepsilon}{\sqrt{1+\varepsilon^2}\ D_{2n}(p)} \tag{17}$$

Hence, the overall group delay is the same as the ladder filter and $$|P_2|^2 = \frac{[\varepsilon N_n(-\omega^2)+1]^2}{(1+\varepsilon^2)[1+N_n^2(-\omega^2)]} \tag{18}$$

$$|Q_2|^2 = \frac{[-N_n(-\omega^2)+\varepsilon]^2}{(1+\varepsilon^2)[1+N_n^2(-\omega^2)]}$$

If $$N_n(-\omega^2) = -\varepsilon(\cos[2n\cos^{-1}\omega]-1) \tag{19}$$

then $$|P_2|^2 = \frac{[1+\varepsilon^2-\varepsilon^2\cos[2n\cos^{-1}\omega]]^2}{(1+\varepsilon^2)[1+\varepsilon^2(\cos[2n\cos^{-1}\omega]-1)^2]} \tag{20}$$

and $$|Q_2|^2 = \frac{\varepsilon^2\cos^2[2n\cos^{-1}\omega]}{(1+\varepsilon^2)[1+\varepsilon^2(\cos[2n\cos^{-1}\omega]-1)^2]} \tag{21}$$

which for $\epsilon$ small is approximately equiripple in the passband $-1 \leqq \omega \leqq +1$ The maximum value of $|P_2|^2$ in the passband is $$\frac{1}{1+\varepsilon^2}$$

and the stopband $|Q_2|^2$ for large $\omega$ approaches $$\frac{1}{1+\varepsilon^2}$$

Figure 5:
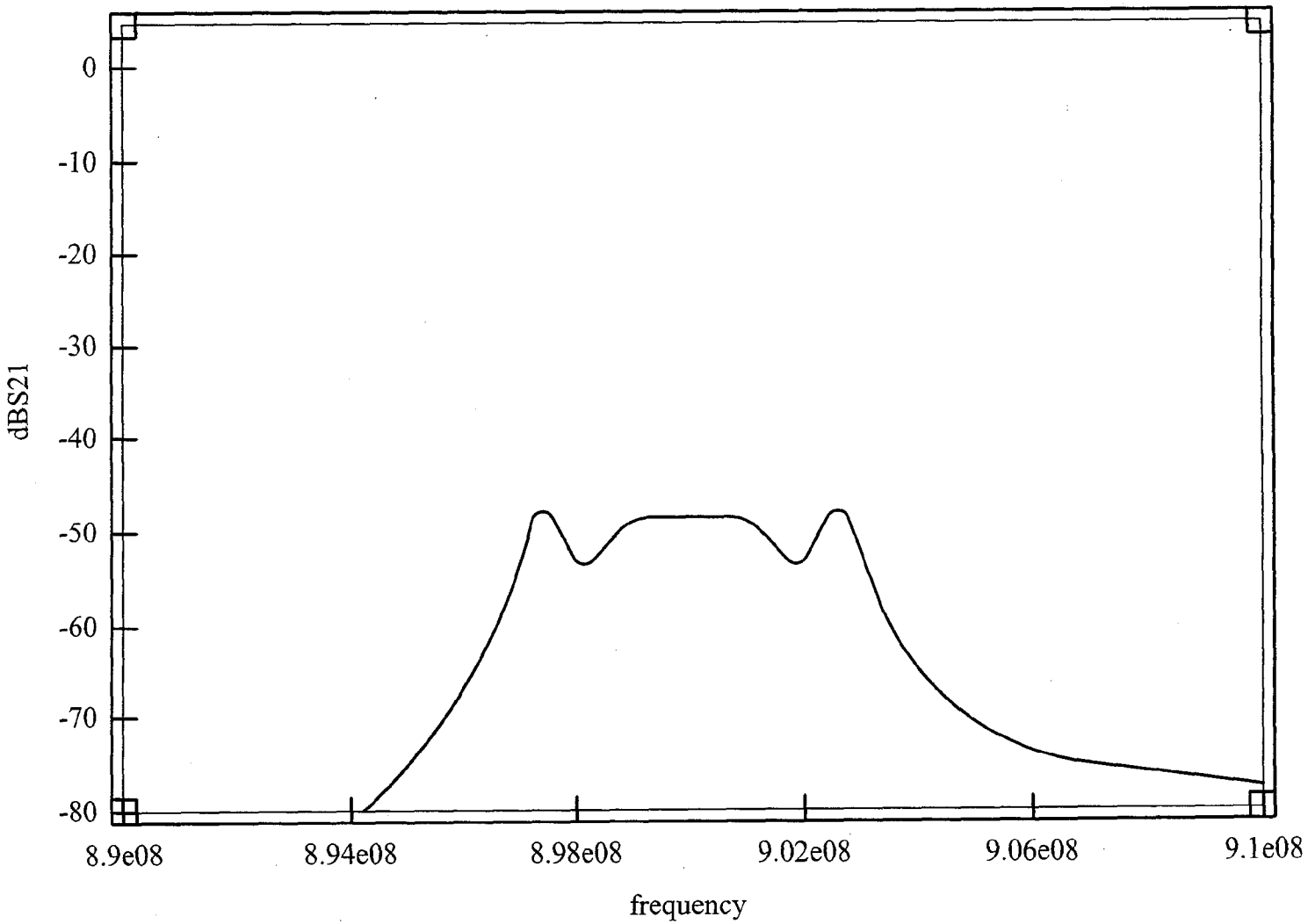
FIGS. 5 to 7 show the isolation, amplitude and delay plots of a band combining filter according to the invention.
Figure 6:
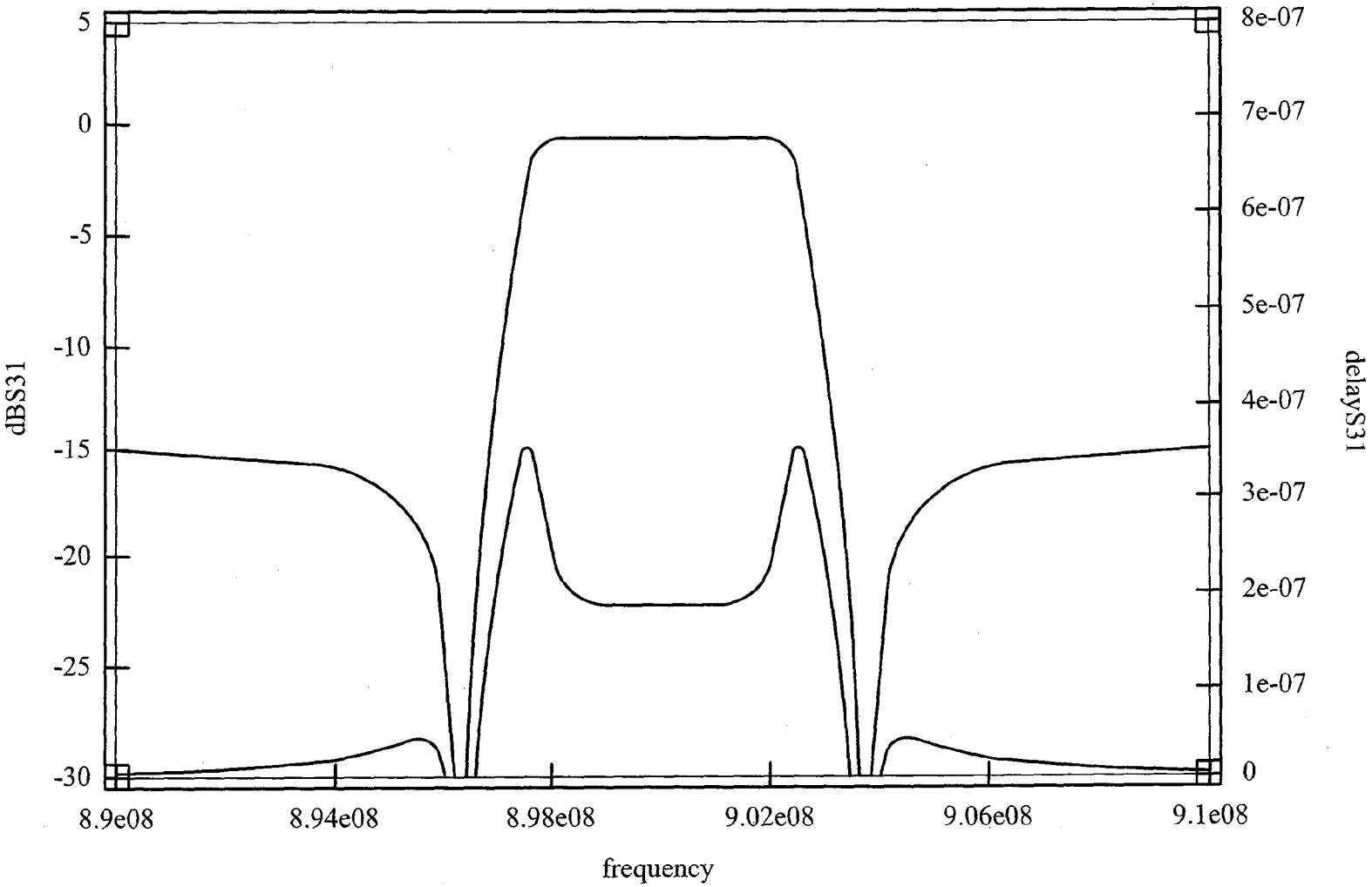
Figure 7:
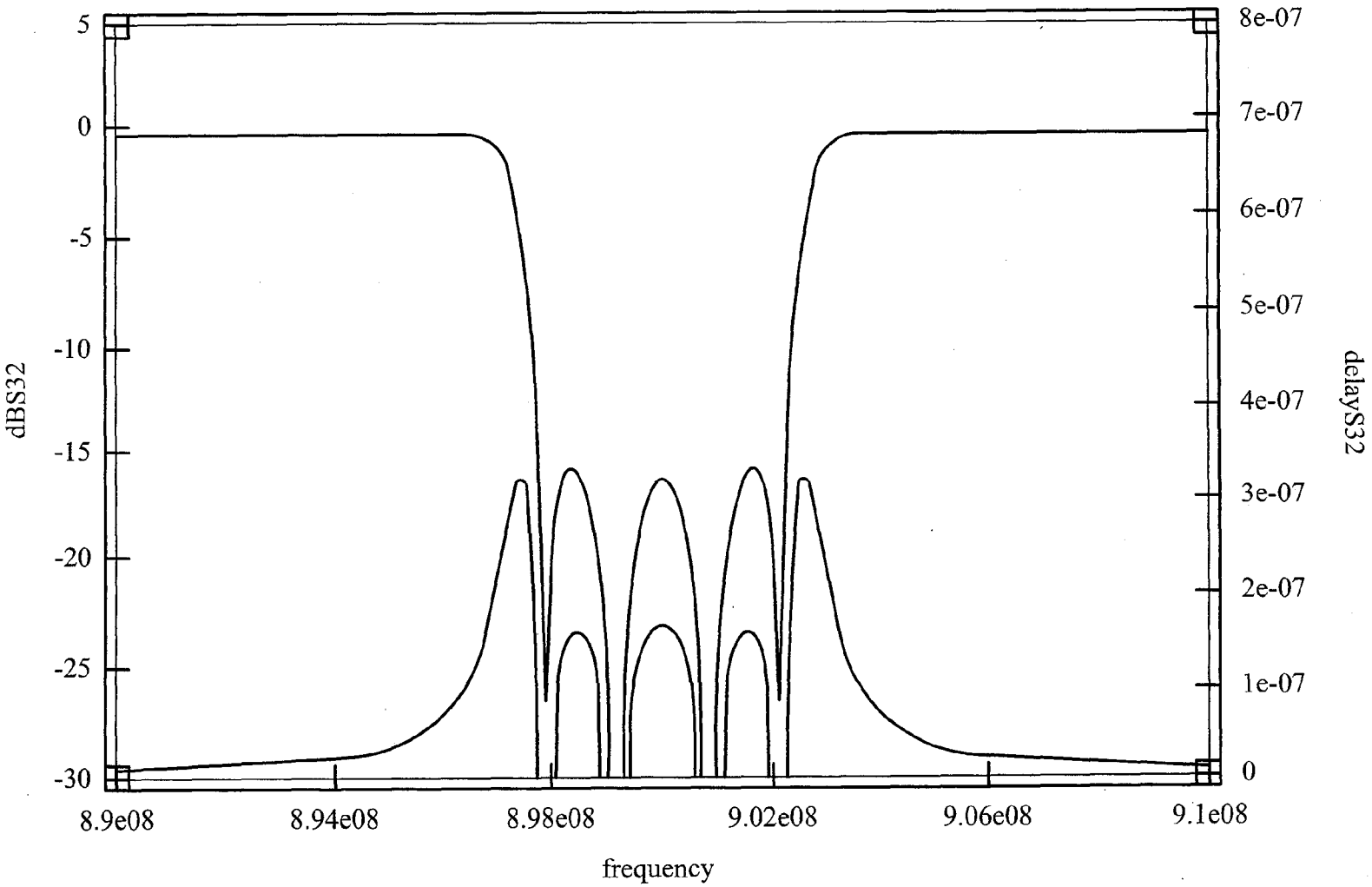

If this level is chosen as approximately 15 dB, then for n=2 we have the isolation, amplitude and delay plots as a function of frequency shown in FIGS. 5, 6 and 7, for signal inputs at ports 1 and 2 with a common output at port 3 where the device has been scaled to 900 MHz with a 4.4 MHz bandwidth. The second network is a 15 dB directional coupler and the ladder networks in the first network are defined by:

$$|R_1|^2 = \frac{\varepsilon^2(\cos[2n\cos^{-1}\omega]-1)^2}{1+\varepsilon^2[\cos[2n\cos^{-1}\omega]-1]^2} \tag{22}$$

This may be factorised in the normal way and synthesised as a 2n th degree ladder structure.

The band combining filter 13 of the invention shows a high degree of uniformity in amplitude and phase across a wide range of frequency making it suitable for signal combining applications.

Cascaded directional filters 10 can provide a compact band combining filter 13 which can provide complex filtering characteristics with relatively simple filter structures. A 4th degree example operating at 900 MHz has been given which is suitable for combining a UMTS channel with an existing GSM system. Furthermore, due to its simplicity, it may readily be reconfigured by tuning the resonant frequencies of the resonators.

Whilst only an example comprising a fourth degree filter and two directional filters 10 has been provided other examples are possible comprising higher order filters or larger numbers of directional filter stages. All show the advantages according to the invention.

Similarly, alternative to low pass ladder networks for the first and second filters 11 of the directional filters 10 may be alternative low pass filter types, high pass filters, band stop filters and band pass filters. Such filters 11 are known to one skilled in the art and are not described in detail. The reference to the behaviour of filters 11 is reference to behaviour within the communications band of interest. For example reference to a frequency independent filter 11 is reference to a filter 11 which is frequency independent within the communications band where the reflection functions of the directional filters 10 overlap. The filter 11 may for example roll off at high and low frequencies.

According to a further aspect of the invention there is provided a signal transmitter (not shown) including a band combining filter 13 according to the invention. First and second signal sources (not shown) are connected to the inputs at the start of the cascade. An antenna is connected to one of the outputs at the end of the cascade.

The invention claimed is:

1. A band combining filter for passing signals in a communications band, the band combining filter comprising;

a plurality of cascaded directional filters, each directional filter having at least two inputs and at least two outputs, the nth directional filter being arranged such that the output signals $O_1$ and $O_2$ from the first and second outputs are related to the input signals $I_1$, $I_2$ to the first and second inputs by the relation $$\begin{pmatrix} O_1 \\ O_2 \end{pmatrix} = \begin{pmatrix} R_{n1} & T_{n2} \\ T_{n1} & R_{n2} \end{pmatrix} \begin{pmatrix} I_1 \\ I_2 \end{pmatrix}$$

with R and T being reflection and transmission functions respectively;

the directional filters being connected in a cascade with the first and second inputs of the nth directional filter being connected to the first and second outputs of the (n−1) th directional filter respectively in the cascade;

characterised in that at least one of the reflection functions $R_n$ overlaps with the corresponding reflection function $R_{n-1}$ within the communication band but is different thereto.

2. A band combining filter as claimed in claim 1, wherein the directional filters are symmetric and reciprocal with $R_{n1}=R_{n2}=R_n$ and $T_{n1}=T_{n2}=T_n$.

3. A band combining filter as claimed in claim 1, wherein at least one of the directional filters comprises;

a first signal splitter having first input port connected to the first input and a first output port connected to the first output;

a second signal splitter having a second input port connected to the second input and a second output port connected to the second output;

each of the first and second signal splitters having first and second connection ports;

the two first connection ports being connected together by a first filter;

the two second connection ports being connected together by a second filter.

4. A band combining filter as claimed in claim 3, wherein the first and second signal splitters are 3 dB hybrids.

5. A band combining filter as claimed in claim 3, wherein the first and second filters are identical.

6. A band combining filter as claimed in claim 3, wherein the first and second filters are different to each other.

7. A band combining filter as claimed in claim 3, wherein each of the first and second filters of at least one directional filter consisting of a low pass filter, high pass filter, band stop filter or band pass filter within the communications band.

8. A band combining filter as claimed in claim 3, wherein the first and second filters of at least one directional filter are frequency independent within the communication band.

9. A band combining filter as claimed in claim 1, comprising first and second directional filters only.

10. A band combining filter as claimed in claim 9, wherein each of the first and second filters of the first directional filter consisting of a low pass filter, a high pass filter, a band stop filter or band pass filter within the communications band and the first and second filters of the second directional filter are frequency independent within the communications band.

11. A band combining filter as claimed in claim 10, wherein at least one of the first and second filters of the first directional filter is a low pass filter, the low pass filter being a ladder filter of even order.

12. A signal transmitter comprising;

a plurality of cascaded directional filters;

each directional filter having at least two inputs and at least two outputs, the nth directional filter being arranges such that the output signals $O_1$ and $O_2$ from the first and second outputs are related to the input signals $I_1$, $I_2$ to the first and second inputs by the relation $$\begin{pmatrix} O_1 \\ O_2 \end{pmatrix} = \begin{pmatrix} R_{n1} & T_{n2} \\ T_{n1} & R_{n2} \end{pmatrix} \begin{pmatrix} I_1 \\ I_2 \end{pmatrix}$$

with R and T being reflection and transmission functions respectively;

the directional filters being connected in a cascade with the first and second inputs of the nth directional filter being connected to the first and second outputs of the (n−1)th directional filter respectively in the cascade;

at least one of the reflection functions $R_n$ overlapping with the corresponding reflection function $R_{n-1}$ within the communication band but is different thereto;

a first signal source in electrical communication with the first input of the first directional filter in the cascade;

a second signal source in electrical communication with the second input of the first directional filter in the cascade; and, an antenna connected to an output of the last directional filter in the cascade.

13. A signal transmitter as claimed in claim 12, wherein the directional filters are symmetric and reciprocal with $R_{n1}=R_{n2}=R_n$ and $T_{n1}=T_{n2}=T_n$.

14. A signal transmitter as claimed in claim 12, wherein at least one of the directional filters comprises;

a first signal splitter having first input port connected to the first input and a first output port connected to the first output;

a second signal splitter having a second input port connected to the second input and a second output port connected to the second output;

each of the first and second signal splitters having first and second connection ports;

the two first connection ports being connected together by a first filter;

the two second connection ports being connected together by a second filter.

15. A signal transmitter as claimed in claim 14, wherein the first and second signal splitters are 3 dB hybrids.

16. A signal transmitter as claimed in claim 14, wherein the first and second filters are identical.

17. A signal transmitter as claimed in claim 14, wherein the first and second filters are different to each other.

18. A signal transmitter as claimed in claim 14, wherein each of the first and second filters of at least one directional filter consisting of a low pass filter, high pass filter, band stop filter or band pass filter within the communications band.

19. A signal transmitter as claimed in claim 14, wherein the first and second filters of at least one directional filter are frequency independent within the communication band.

20. A signal transmitter as claimed in claim 12, comprising first and second directional filters only.

21. A signal transmitter as claimed in claim 20, wherein each of the first and second filters of the first directional filter consisting of a low pass filter, a high pass filter, a band stop filter or band pass filter within the communications band and the first and second filters of the second directional filter are frequency independent within the communications band.

22. A signal transmitter as claimed in claim 21, wherein at least one of the first and second filters of the first directional filter is a low pass filter, the low pass filter being a ladder filter of even order.

* * * * *